US010087815B2

(12) United States Patent
Naik et al.

(10) Patent No.: US 10,087,815 B2
(45) Date of Patent: Oct. 2, 2018

(54) SYSTEM AND METHOD FOR ESTIMATING A CYLINDER WALL TEMPERATURE AND FOR CONTROLLING COOLANT FLOW THROUGH AN ENGINE BASED ON THE ESTIMATED CYLINDER WALL TEMPERATURE

(71) Applicant: GM Global Technology Operations LLC, Detroit, MI (US)

(72) Inventors: Sanjeev M. Naik, Troy, MI (US); Yue-Ming Chen, Ann Arbor, MI (US); Irina N. Dmitrieva, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 553 days.

(21) Appl. No.: 14/790,387

(22) Filed: Jul. 2, 2015

(65) Prior Publication Data

US 2017/0002721 A1 Jan. 5, 2017

(51) Int. Cl.

| | |
|---|---|
| ***F01P 7/16*** | (2006.01) |
| ***F01P 3/02*** | (2006.01) |
| ***F04B 49/02*** | (2006.01) |
| ***F04B 51/00*** | (2006.01) |
| ***F01P 5/14*** | (2006.01) |

(Continued)

(52) U.S. Cl.

CPC ..... *F01P 7/167* (2013.01); *F01P 3/02* (2013.01); *F01P 3/20* (2013.01); *F01P 5/10* (2013.01); *F01P 5/14* (2013.01); *F01P 7/164* (2013.01); *F04B 49/02* (2013.01); *F04B 51/00* (2013.01); *F01P 2003/001* (2013.01); *F01P 2003/021* (2013.01); *F04B 2203/0605* (2013.01)

(58) Field of Classification Search

CPC .... F01P 7/164; F01P 7/167; F01P 3/02; F01P 3/20; F01P 5/10; F01P 5/14; F01P 2003/021; F01P 2003/001; F04B 51/00; F04B 49/02; F04B 2203/0605

See application file for complete search history.

(56) References Cited

U.S. PATENT DOCUMENTS 3,817,224 A 6/1974 Pluequet et al.
4,616,599 A 10/1986 Taguchi et al.

(Continued)

FOREIGN PATENT DOCUMENTS

CN 102076937 A 5/2011
DE 19728351 A1 1/1999

(Continued)

OTHER PUBLICATIONS

U.S. Appl. No. 14/790,387, filed Jul. 2002, Naik et al.

(Continued)

*Primary Examiner* — Grant Moubry

(57) ABSTRACT

A system includes a temperature estimation module and a pump control module. The temperature estimation module estimates a temperature of coolant flowing through an engine. The temperature estimation module estimates a temperature of a cylinder wall in the engine based on the estimated coolant temperature and a measured coolant temperature. The pump control module controls a coolant pump to adjust an actual rate of coolant flow through the engine based on the estimated cylinder wall temperature.

16 Claims, 4 Drawing Sheets

(51) Int. Cl.

| | |
|---|---|
| ***F01P 3/20*** | (2006.01) |
| ***F01P 5/10*** | (2006.01) |
| *F01P 3/00* | (2006.01) |

(56) References Cited

U.S. PATENT DOCUMENTS

| | | | | |
|---|---|---|---|---|
| 5,390,632 | A | 2/1995 | Ikebe et al. | |
| 5,754,971 | A | 5/1998 | Matsumoto et al. | |
| 6,169,953 | B1 | 1/2001 | Panoushek et al. | |
| 6,343,572 | B1 | 2/2002 | Pfaff et al. | |
| 6,397,820 | B1 | 6/2002 | Novak et al. | |
| 6,668,766 | B1 | 12/2003 | Liederman et al. | |
| 6,745,726 | B2 | 6/2004 | Joyce et al. | |
| 6,758,172 | B2 | 7/2004 | Morgan et al. | |
| 6,802,283 | B2 | 10/2004 | Liederman et al. | |
| 6,866,092 | B1 | 3/2005 | Molivadas | |
| 7,263,954 | B2 | 9/2007 | Piddock et al. | |
| 7,409,928 | B2 * | 8/2008 | Rizoulis | F01P 7/14 123/41.01 |
| 7,997,510 | B2 | 8/2011 | Pavia et al. | |
| 8,224,517 | B2 | 7/2012 | Eser et al. | |
| 8,596,228 | B2 * | 12/2013 | Kinomura | F01P 7/165 123/41.1 |
| 8,813,692 | B2 | 8/2014 | Bialas et al. | |
| 8,813,693 | B2 | 8/2014 | Bialas et al. | |
| 9,745,889 | B2 | 8/2017 | Naik et al. | |
| 2006/0162677 | A1 | 7/2006 | Piddock et al. | |
| 2010/0038158 | A1 | 2/2010 | Whitney et al. | |
| 2011/0098883 | A1 | 4/2011 | Eser et al. | |
| 2011/0120216 | A1 | 5/2011 | Sugimoto | |
| 2012/0215397 | A1 | 8/2012 | Anilovich et al. | |
| 2012/0216761 | A1 * | 8/2012 | Takahashi | F01P 7/16 123/41.02 |
| 2013/0089436 | A1 | 4/2013 | Bialas et al. | |
| 2014/0072450 | A1 | 3/2014 | Levijoki | |
| 2014/0230761 | A1 | 8/2014 | Pilavdzic | |
| 2014/0230762 | A1 | 8/2014 | Nakashima | |

FOREIGN PATENT DOCUMENTS

| | | | |
|---|---|---|---|
| DE | 10316753 | A1 | 10/2003 |
| DE | 10334501 | A1 | 3/2004 |
| DE | 102008032130 | A1 | 1/2010 |
| DE | 102012208003 | A1 | 11/2012 |
| DE | 102012218133 | A1 | 4/2013 |

OTHER PUBLICATIONS

Non-Final Office Action dated Jan. 6, 2014 in U.S. Appl. No. 13/269,048; 6 pages.

Non-Final Office Action dated Jan. 3, 2014 in U.S. Appl. No. 13/111,318; 5 pages.

Office Action dated Feb. 23, 2015, from the German Patent Office for German Patent Application No. 10 2013 217 253.2; 4 pages.

Glossary of Judicial Claim Constructions in the Electronics, Computer and Business Method Arts.

U.S. Appl. No. 13/606,565, filed Sep. 7, 2012, Levijoki.

U.S. Appl. No. 14/790,384, filed Jul. 2, 2015, Naik et al.

* cited by examiner

SYSTEM AND METHOD FOR ESTIMATING A CYLINDER WALL TEMPERATURE AND FOR CONTROLLING COOLANT FLOW THROUGH AN ENGINE BASED ON THE ESTIMATED CYLINDER WALL TEMPERATURE

CROSS-REFERENCE TO RELATED APPLICATIONS

This application is related to U.S. patent application Ser. No. 13/606,565 filed on Sep. 7, 2012, and Ser. No. 14/790,384 filed on Jul. 2, 2015. The entire disclosures of the above applications are incorporated herein by reference.

FIELD

The present disclosure relates to internal combustion engines, and more specifically, to systems and methods for estimating a cylinder wall temperature and for controlling coolant flow through an engine based on the estimated cylinder wall temperature.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A cooling system for an engine typically includes a radiator, a coolant pump, an inlet line, and an outlet line. The inlet line extends to an inlet of the engine from an outlet of the radiator. The outlet line extends from an outlet of the engine to an inlet of the radiator. The coolant pump circulates coolant through the inlet line, the engine, the outlet line, and the radiator. In some cases, the cooling system includes a bypass valve that allows coolant to bypass the radiator when the bypass valve is open.

An engine control system typically controls coolant flow through the engine by adjusting the speed of the coolant pump. Conventional engine control systems adjust the coolant flow to minimize the difference between a desired coolant temperature and a measured coolant temperature. Controlling coolant flow in this way may be referred to as a feedback approach.

Controlling coolant flow using only the feedback approach may be adequate during steady-state conditions, such as when a vehicle is traveling at a constant speed. However, controlling coolant flow using only the feedback approach may not adjust the coolant temperature as quickly and as accurately as desired during transient conditions, such as when a vehicle is accelerating.

SUMMARY

A system includes a temperature estimation module and a pump control module. The temperature estimation module estimates a temperature of coolant flowing through an engine. The temperature estimation module estimates a temperature of a cylinder wall in the engine based on the estimated coolant temperature and a measured coolant temperature. The pump control module controls a coolant pump to adjust an actual rate of coolant flow through the engine based on the estimated cylinder wall temperature.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A system and method according to the present disclosure controls coolant flow through an engine using both a feedforward approach and a feedback approach. In the feedback approach, the system and method determines a coolant flow rate adjustment based on a difference between a desired coolant temperature and a measured coolant temperature. In the feedforward approach, the system and method determines a desired coolant flow rate based on an actual rate of heat transfer from the engine to coolant flowing through the engine. The system and method then controls the speed of a coolant pump to minimize the difference between an actual coolant flow rate and a sum of the desired coolant flow rate and the coolant flow rate adjustment.

The system and method may determine the rate of heat transfer from the engine to coolant flowing through the engine using a mathematical model. In one example, the system and method determines the heat transfer rate based on a temperature of a cylinder wall in the engine and an average value of a coolant inlet temperature and a coolant outlet temperature. The system and method may also determine the heat transfer rate based on physical properties of the cylinder wall and the coolant, such as mass, specific heat, heat transfer coefficient, and/or surface area.

Controlling the coolant flow through the engine using both a feedforward approach and a feedback approach improves the system response time relative to controlling the coolant flow using only the feedback approach. In addition, controlling the coolant flow using the feedback approach corrects for any errors associated with the mathematical model used in the feedforward approach. Thus, the system and method according to the present disclosure adjusts the coolant flow to accurately and quickly control the coolant temperature in both steady-state and transient conditions.

A system and method according to the present disclosure estimates a temperature of a cylinder wall in an engine using both an analytical model and closed-loop feedback. The system and method may use the analytical model to estimate the cylinder wall temperature and an average coolant temperature based on a rate of heat rejection from the engine, a desired rate of coolant flow through the engine, and a measured coolant inlet temperature. The average coolant temperature is an average value of a coolant inlet temperature and a coolant outlet temperature. The analytical model may also take into account closed-loop feedback such as a difference between the estimated average coolant temperature and an average measured coolant temperature. The average measured coolant temperature is an average value of a measured inlet coolant temperature and a measured outlet coolant temperature. The system and method may then control coolant flow through the engine based on the estimated cylinder wall temperature using the feedforward and feedback approaches discussed above.

Figure 1:
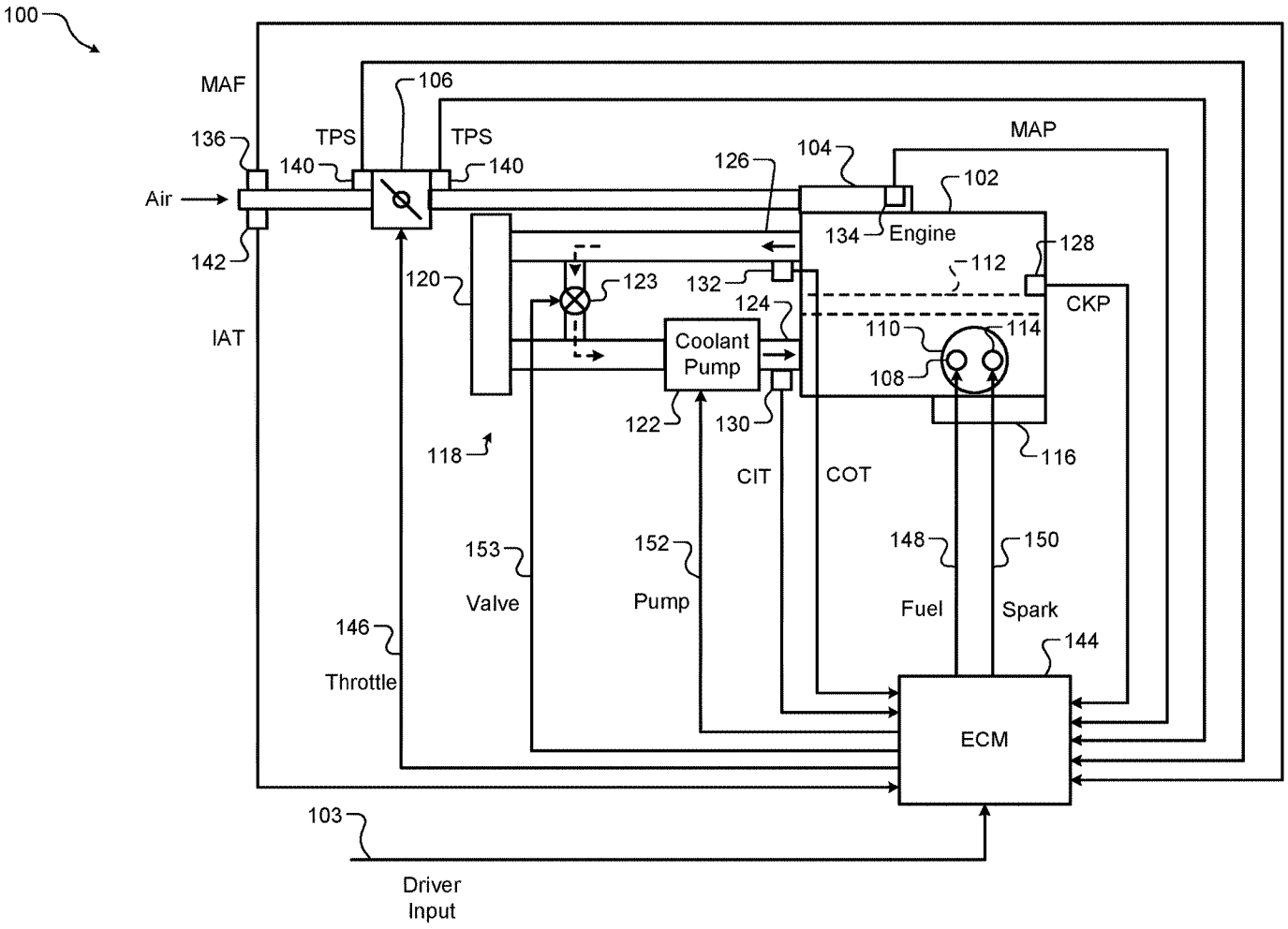
FIG. 1 is a functional block diagram of an example engine system according to the principles of the present disclosure.

Referring now to FIG. 1, an engine system 100 includes an engine 102 that combusts an air/fuel mixture to produce drive torque for a vehicle. The amount of drive torque produced by the engine 102 is based on a driver input 103. The driver input 103 may be generated based on a position of an accelerator pedal. The driver input 103 may also be generated by a cruise control system, which may be an adaptive cruise control system that varies vehicle speed to maintain a predetermined following distance.

Air is drawn into the engine 102 through an intake manifold 104. The amount of air drawn into the engine 102 may be varied using a throttle valve 106. One or more fuel injectors, such as a fuel injector 108, inject fuel into the air to form an air/fuel mixture. The air/fuel mixture is combusted within cylinders of the engine 102, such as a cylinder 110. Although the engine 102 is depicted as including one cylinder, the engine 102 may include more than one cylinder.

The cylinder 110 includes a piston (not shown) that is mechanically linked to a crankshaft 112. One combustion cycle within the cylinder 110 may include four phases: an intake phase, a compression phase, a combustion phase, and an exhaust phase. During the intake phase, the piston moves toward a bottommost position and draws air into the cylinder 110. During the compression phase, the piston moves toward a topmost position and compresses the air or air/fuel mixture within the cylinder 110.

During the combustion phase, spark from a spark plug 114 ignites the air/fuel mixture. The combustion of the air/fuel mixture drives the piston back toward the bottommost position, and the piston drives rotation of the crankshaft 112. During the exhaust phase, exhaust gas is expelled from the cylinder 110 through an exhaust manifold 116 to complete the combustion cycle. The engine 102 outputs torque to a transmission (not shown) via the crankshaft 112. Although the engine 102 is described as a spark-ignition engine, the engine 102 may be a compression-ignition engine.

A cooling system 118 for the engine 102 includes a radiator 120, a coolant pump 122, and a bypass valve 123. The radiator 120 cools coolant that flows through the radiator 120, and the coolant pump 122 circulates coolant through the engine 102 and the radiator 120. Coolant flows from the radiator 120 to the coolant pump 122, from the coolant pump 122 to the engine 102 through an inlet line 124, and from the engine 102 back to the radiator 120 through an outlet line 126.

The coolant pump 122 may be a switchable water pump. In one example, the coolant pump 122 is a centrifugal pump including an impeller and a clutch that selectively engages the impeller with a pulley driven by a belt connected to the crankshaft 112. The clutch engages the impeller with the pulley and disengages the impeller from the pulley when the coolant pump 122 is switched on and off, respectively. Coolant may enter the coolant pump 122 through an inlet located near the center of the coolant pump 122, and the impeller may force the coolant radially outward to an outlet located at the outside of the coolant pump 122. Alternatively, the coolant pump 122 may be an electric pump.

The bypass valve 123 may be opened to allow coolant to bypass the radiator 120 as the coolant flows from the outlet line 126 to the inlet line 124. The bypass valve 123 may be adjusted to a fully closed position, a fully opened position, and to partially open positions (i.e., positions between the fully closed position and the fully open position). When the bypass valve 123 is adjusted to a partially open position, part of the coolant flow exiting the engine 102 passes through the radiator 120 and part of the coolant flow exiting the engine 102 passes through the bypass valve 123.

A crankshaft position (CKP) sensor 128 measures the position of the crankshaft 112, which may be used to determine the speed of the engine 102. A coolant inlet temperature (CIT) sensor 130 measures the temperature of coolant entering the engine 102, which is referred to as a coolant inlet temperature. A coolant outlet temperature (COT) sensor 132 measures the temperature of coolant exiting the engine 102, which is referred to as a coolant outlet temperature. The CIT sensor 130 and the COT sensor 132 may be located within the inlet line 124 and the outlet line 126, respectively, or at other locations where coolant is circulated, such as in a coolant passage (not shown) of the engine 102 and/or in the radiator 120.

The pressure within the intake manifold 104 may be measured using a manifold absolute pressure (MAP) sensor 134. In various implementations, engine vacuum, which is the difference between ambient air pressure and the pressure within the intake manifold 104, may be measured. The mass flow rate of air flowing into the intake manifold 104 may be measured using a mass air flow (MAF) sensor 136. In various implementations, the MAF sensor 136 may be located in a housing that also includes the throttle valve 106.

The position of the throttle valve 106 may be measured using one or more throttle position sensors (TPS) 140. The ambient temperature of air being drawn into the engine 102 may be measured using an intake air temperature (IAT) sensor 142. An engine control module (ECM) 144 controls the throttle valve 106, the fuel injector 108, the spark plug 114, and the coolant pump 122 based on signals from the sensors.

The ECM 144 outputs a throttle control signal 146 to control the position of the throttle valve 106. The ECM 144 outputs a fuel control signal 148 to control the opening timing and duration of the fuel injector 108. The ECM 144 outputs a spark control signal 150 to control spark timing of the spark plug 114. The ECM 144 outputs a pump control signal 152 to control the speed of the coolant pump 122. The ECM 144 outputs a valve control signal 153 to control the opening area of the bypass valve 123.

The ECM 144 controls the coolant pump 122 to adjust the actual rate of coolant flow through the engine 102 based on a desired rate of coolant flow through the engine 102 and a coolant flow rate adjustment. The ECM 144 determines the coolant flow rate adjustment based on a difference between a desired coolant outlet temperature and the coolant outlet temperature from the COT sensor 132. The ECM 144 determines the desired coolant flow rate based on a rate of heat transfer from the engine 102 to coolant flowing through the engine 102. The ECM 144 determines the heat transfer rate based on a temperature of a cylinder wall in the engine 102, the coolant inlet and outlet temperatures from the CIT and COT sensors 130 and 132, and physical properties of the cylinder wall and the coolant.

Figure 2:
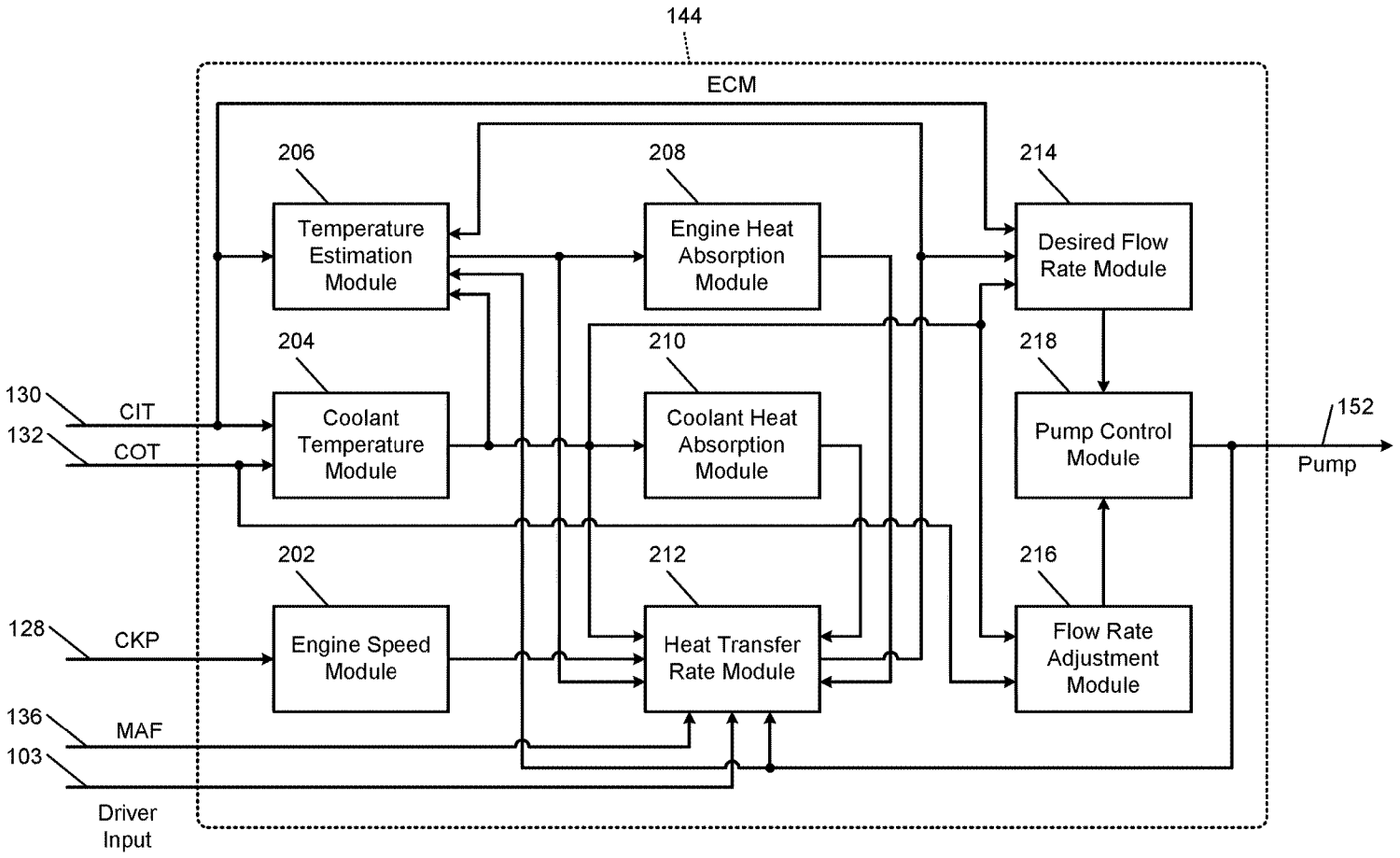
FIG. 2 is a functional block diagram of an example control system according to the principles of the present disclosure.

Referring now to FIG. 2, an example implementation of the ECM 144 includes an engine speed module 202 that determines the speed of the engine 102. The engine speed module 202 may determine the engine speed based on the crankshaft position from the CKP sensor 128. For example, the engine speed module 202 may calculate the engine speed based on a period that elapses as the crankshaft completes one or more revolutions. The engine speed module 202 outputs the engine speed.

A coolant temperature module 204 determines an average value of the coolant inlet temperature measured by the CIT sensor 130 and the coolant outlet temperature measured by the COT sensor 132. This average value may be referred to as an average measured coolant temperature. The coolant temperature module 204 outputs the average measured coolant temperature.

A temperature estimation module 206 estimates an average value of the coolant inlet temperature and the coolant outlet temperature independent of the measured coolant inlet temperature and the measured coolant outlet temperature. This estimate of the average value may be referred to as an estimated average coolant temperature. The temperature estimation module 206 also estimates a temperature of a cylinder wall in the engine 102 based on the average measured coolant temperature and the estimated average coolant temperature. In one example, the temperature estimation module 206 estimates the average coolant temperature and the cylinder wall temperature based on a difference between the average measured coolant temperature and the estimated average coolant temperature. The temperature estimation module 206 outputs the estimated average coolant temperature and the estimated cylinder wall temperature.

The temperature estimation module 206 may estimate the average coolant temperature and the cylinder wall temperature based on estimates of these values from a previous iteration, a sampling period, and an adjustment rate vector. For example, the temperature estimation module 206 may estimate the average coolant temperature and the cylinder wall temperature using a relationship such as $$\hat{X}(k+1) = \hat{X}(k) + T_s * \dot{\hat{X}}(k) \tag{1}$$

$$\text{where } \hat{X}(k) = \begin{bmatrix} \hat{T}_{eng}^{avg}(k) \\ \hat{T}_{wall}(k) \end{bmatrix} \text{ and } X(k+1) = \begin{bmatrix} \hat{T}_{eng}^{avg}(k+1) \\ \hat{T}_{wall}(k+1) \end{bmatrix}$$

and where $\hat{T}_{eng}^{avg}(k)$ is the estimated average coolant temperature for iteration number k, $\hat{T}_{wall}(k)$ is the estimated cylinder wall temperature for iteration number k, $\hat{T}_{eng}^{avg}(k+1)$ is the estimated average coolant temperature for iteration number k+1, $\hat{T}_{wall}(k+1)$ is the estimated cylinder wall temperature for iteration number k+1, $T_s$ is the sampling period, and $\dot{\hat{X}}(k)$ is the adjustment rate vector.

The sampling period is the period between consecutive estimations of the average coolant temperature and the cylinder wall temperature. For example, the average coolant temperature and the cylinder wall temperature may be estimated at first and second times for iteration numbers k and k+1, respectively, and the period between the first and second times may be the sampling period $T_s$. The sampling period may be a predetermined period (e.g., a period between 10 milliseconds (ms) and 50 ms).

The temperature estimation module 206 may determine the adjustment rate vector based on a system matrix, estimates of the average coolant temperature and the cylinder wall temperature from a previous iteration, an input vector, a gain matrix, and the difference between the average measured coolant temperature and the estimated average coolant temperature. For example, the temperature estimation module 206 may determine the adjustment rate vector using a relationship such as $$\dot{\hat{X}}(k) = A(k)\hat{X}(k) + B(k) + K(y(k) - (\hat{y}(k)) \tag{2}$$

$$\text{where } \hat{X}(k) = \begin{bmatrix} \hat{T}_{eng}^{avg}(k) \\ \hat{T}_{wall}(k) \end{bmatrix}, \hat{y}(k) = \hat{T}_{eng}^{avg}(k),$$

$$\text{and } y(k) = T_{eng}^{avg}(k)$$

and where A(k) is the system matrix for iteration number k, B(k) is the input vector for iteration number k, K is the gain matrix, $\hat{T}_{eng}^{avg}(k)$ is the estimated average coolant temperature for iteration number k, and $\hat{T}_{eng}^{avg}(k)$ is the average measured coolant temperature for iteration number k.

The temperature estimation module 206 may determine the system matrix using the following relationship $$A(k) = \begin{bmatrix} -\left\{\frac{h_w A - w}{m_c c_{pc}} + \frac{2\dot{m}_c(k)}{m_c}\right\} & \frac{h_w A_w}{m_c c_{pc}} \\ \frac{h_w A_w}{m_w c_{pw}} & -\frac{h_w A_w}{m_c c_{pc}} \end{bmatrix} \tag{3}$$

where A(k) is the system matrix for iteration number k, $h_w$ is a heat transfer coefficient of the cylinder wall, $A_w$ is a surface area of the cylinder wall, $m_c$ is a mass of coolant flowing through the engine 102, $\dot{m}_c$ is a mass flow rate of the coolant for iteration number k, $c_{pc}$ is a specific heat of the coolant, $m_w$ is a mass of the cylinder wall and may include the mass of a surrounding jacket, and $c_{pw}$ is a specific heat of the cylinder wall. The temperature estimation module 206 may determine the coolant flow rate based on a function or mapping that relates the speed of the coolant pump 122 to the coolant flow rate. The temperature estimation module 206 may assume that the speed of the coolant pump 122 is equal to a commanded pump speed indicated by the pump control signal 152. Alternatively, the speed of the coolant pump 122 may be measured and provided to the temperature estimation module 206. Other than the coolant flow rate, the parameters used to determine the system matrix may be predetermined.

The temperature estimation module 206 may determine the input vector using the following relationship $$B(k) = \begin{bmatrix} \frac{2\dot{m}_c(k)}{m_c} T_{in}(k) \\ \frac{(\dot{Q}_{rej})_{des}(k)}{m_w c_{pw}} \end{bmatrix} \tag{4}$$

where B(k) is the input vector for iteration number k, $m_c$ is a mass of coolant flowing through the engine 102, $\dot{m}_c$ is the mass flow rate of the coolant for iteration number k, $T_{in}(k)$ is the coolant inlet temperature from the CIT sensor 130 for iteration number k, $(\dot{Q}_{rej})_{des}(k)$ is a desired rate of heat rejection from the engine 102 for iteration number k, $m_w$ is the mass of the cylinder wall, and $c_{pw}$ is the specific heat of the cylinder wall.

The temperature estimation module 206 may determine the gain matrix using the following relationship $$K = \begin{bmatrix} G_1 \\ G_2 \end{bmatrix} \tag{5}$$

where $G_1$ is a first gain and $G_2$ is a second gain. The first gain and the second gain may be predetermined values.

An engine heat absorption module 208 determines an actual rate of change in heat absorbed by the engine 102. Components of the engine 102 (e.g., a cylinder wall) absorb heat resulting from combustion of air and fuel within cylinders of the engine 102. The engine heat absorption module 208 determines the rate of change in this heat absorption based on a change in the cylinder wall temperature and a period associated therewith. For example, the engine heat absorption module 208 may determine the rate of change in the heat absorbed by the engine 102 using a relationship such as $$\dot{Q}_{eng} = m_w c_{pw} \frac{\Delta T_w}{\Delta t} \tag{6}$$

where $\dot{Q}_{eng}$ is the rate of change in the heat absorbed by the engine 102, $m_w$ is the mass of the cylinder wall, $c_{pw}$ is the specific heat of the cylinder wall, $\Delta T_w$ is a change in the cylinder wall temperature over a period, and $\Delta t$ is the period. The engine heat absorption module 208 outputs the rate of change in heat absorbed by the engine 102.

A coolant heat absorption module 210 determines an actual rate of change in heat absorbed by coolant flowing through the engine 102. The coolant heat absorption module 210 determines the rate of change in heat absorbed by the coolant based on a change in the average coolant temperature and a period associated therewith. For example, the coolant heat absorption module 210 may determine the rate of change in the heat absorbed by the coolant using a relationship such as $$\dot{Q}_c = m_c c_{pc} \frac{(\Delta T_c)_{avg}}{\Delta t} \tag{7}$$

where $\dot{Q}_c$ is the rate of change in the heat absorbed by the coolant, $m_c$ is the mass of the coolant, $c_{pc}$ is the specific heat of the coolant, $(\Delta T_c)_{avg}$ is a change in the average coolant temperature over a period, and $\Delta t$ is the period. The coolant heat absorption module 210 outputs the rate of change in heat absorbed by the coolant.

A heat transfer rate module 212 determines a rate of heat transfer from the engine 102 to coolant flowing through the engine 102. The heat transfer rate module 212 may determine this heat transfer rate using a relationship such as $$\dot{Q}_{eng\to c} = (\dot{Q}_{rej})_{des} - \dot{Q}_{eng} - \dot{Q}_c \tag{8}$$

where $\dot{Q}_{eng\to c}$ is the rate of heat transfer from the engine 102 to the coolant and $(\dot{Q}_{rej})_{des}$ is the desired rate of heat rejection from the engine 102.

The heat transfer rate module 212 may determine the desired rate of heat rejection from the engine 102 based on the engine speed and an amount of air delivered to each cylinder of the engine 102, which may be referred to as the air per cylinder. For example, the heat transfer rate module 212 may determine the desired rate of heat rejection from the engine 102 using a function or mapping that relates the engine speed and the air per cylinder to the desired heat rejection rate. Alternatively, the heat transfer rate module 212 may determine the desired rate of heat rejection from the engine 102 based on the engine speed and a desired torque output of the engine 102. The heat transfer rate module 212 outputs the desired rate of heat rejection from the engine 102.

The ECM 144 may divide the mass flow rate of intake air from the MAF sensor 136 by the number of cylinders in the engine 102 to obtain the air per cylinder. The ECM 144 may determine the desired torque output of the engine 102 based on the driver input 103. In one example, the ECM 144 stores one or more mappings of accelerator pedal position to desired torque and determines the desired torque output of the engine 102 based on a selected one of the mappings.

In various implementations, the heat transfer rate module 212 may determine the heat transfer rate from the engine 102 to coolant flowing through the engine 102 using a relationship such as $$\dot{Q}_{eng\to c} = h_w A_w [T_w - (T_c)_{avg}] \tag{9}$$

where $\dot{Q}_{eng\to c}$ is the heat transfer rate, $h_w$ is a heat transfer coefficient of the cylinder wall, $A_w$ is a surface area of the cylinder wall, $T_w$ is the cylinder wall temperature, and $(T_c)_{avg}$ is the average coolant temperature.

In various implementations, the heat transfer rate module 212 may determine the heat transfer rate from the engine 102 to coolant flowing through the engine 102 using a relationship such as $$\dot{Q}_{eng\to c} = [K_{HEX,0} + K_{HEX,1} * (\dot{m}_c)_{act}] * [T_w - (T_c)_{avg}] \tag{10}$$

where $\dot{Q}_{eng\to c}$ is the heat transfer rate, $K_{HEX,0}$ and $K_{HEX,1}$ are effective heat transfer coefficients of the cylinder wall, $(\dot{m}_c)_{act}$ is the actual mass flow rate of the coolant, $T_w$ is the cylinder wall temperature, and $(T_c)_{avg}$ is the average coolant temperature. The heat transfer rate module 212 may estimate the actual mass flow rate of the coolant based on the speed of the coolant pump 122. The heat transfer rate module 212 may assume that the speed of the coolant pump 122 is equal to a commanded pump speed indicated by the pump control signal 152. Alternatively, the speed of the coolant pump 122 may be measured and provided to the heat transfer rate module 212. The heat transfer rate module 212 outputs the heat transfer rate from the engine 102 to coolant flowing through the engine 102.

A desired flow rate module 214 determines a desired rate of coolant flow through the engine 102. The desired flow rate module 214 may determine the desired coolant flow rate using a relationship such as $$(\dot{m}_c)_{des} = \frac{\dot{Q}_{eng\to c}}{c_{pc}[(T_{out})_{des} - T_{in}]} \tag{11}$$

where $(\dot{m}_c)_{des}$ is a desired mass flow rate of coolant flow through the engine 102, $\dot{Q}_{eng\to c}$ is the heat transfer rate from the engine 102 to coolant flowing through the engine 102, $c_{pc}$ is the specific heat of the coolant, $(T_{out})_{des}$ is a desired coolant outlet temperature, and $T_{in}$ is the coolant inlet temperature from the CIT sensor 130. The desired flow rate module 214 outputs the desired coolant flow rate.

The coolant temperature module 204 may determine the desired coolant outlet temperature using a mapping of engine torque and engine speed to coolant outlet temperature. The mapping may be predetermined (e.g., calibrated) to maximize the efficiency of the engine 102. The desired coolant outlet temperature obtained from the mapping may be adjusted to be within predetermined limits if the desired coolant outlet temperature is outside of the limits. The limits may include a lower limit for heating the engine 102 at engine startup and an upper limit for preventing engine overheating.

Relationships (6), (7) and (8) may be substituted into relationship (11) to obtain the following relationship $$(\dot{m}_c)_{des} = \frac{(\dot{Q}_{rej})_{des} - m_w c_{pw}\frac{\Delta T_w}{\Delta t} m_c c_{pc}\frac{(\Delta T_c)_{avg}}{\Delta t}}{c_{pc}[(T_{out})_{des} - T_{in}]} \tag{12}$$

Relationship (9) may be substituted into relationship (11) to obtain the following relationship $$(\dot{m}_c)_{des} = \frac{h_w A_w[T_w - (T_c)_{avg}]}{c_{pc}[(T_{out})_{des} - T_{in}]} \tag{13}$$

Relationship (10) may be substituted into relationship (11) to obtain the following relationship $$(\dot{m}_c)_{des} = \frac{[K_{HEX,0} + K_{HEX,1} * (\dot{m}_c)_{act}] * [T_w - (T_c)_{avg}]}{c_{pc}[(T_{out})_{des} - T_{in}]} \tag{14}$$

The desired mass flow rate of coolant flow $(\dot{m}_c)_{des}$ may be used in place of the actual mass flow rate of coolant $(\dot{m}_c)_{act}$ in relationship (14), and the relationship may be rearranged to solve for the desired mass flow rate of coolant flow as follows $$(\dot{m}_c)_{des} = \frac{K_{HEX,0} * [T_w - (T_c)_{avg}]}{c_{pc}[(T_{out})_{des} - T_{in}] - K_{HEX,1} * [T_w - (T_c)_{avg}]} \tag{15}$$

A flow rate adjustment module 216 determines a coolant flow rate adjustment based on a difference between a desired coolant temperature and a measured coolant temperature. The desired coolant temperature may be the desired coolant outlet temperature determined by the coolant temperature module 204. The measured coolant temperature may be the coolant outlet temperature from the COT sensor 132. The flow rate adjustment module 216 outputs the coolant flow rate adjustment.

A pump control module 218 outputs the pump control signal 152 to control the speed of the coolant pump 122. The pump control module 218 may control the speed of the coolant pump 122 to adjust an actual rate of coolant flow through the engine 102 based on the desired coolant flow rate and the coolant flow rate adjustment. In one example, the pump control module 218 controls the speed of the coolant pump 122 to minimize a difference between the actual coolant flow rate and a sum of the desired coolant flow rate and the coolant flow rate adjustment.

Figure 3:
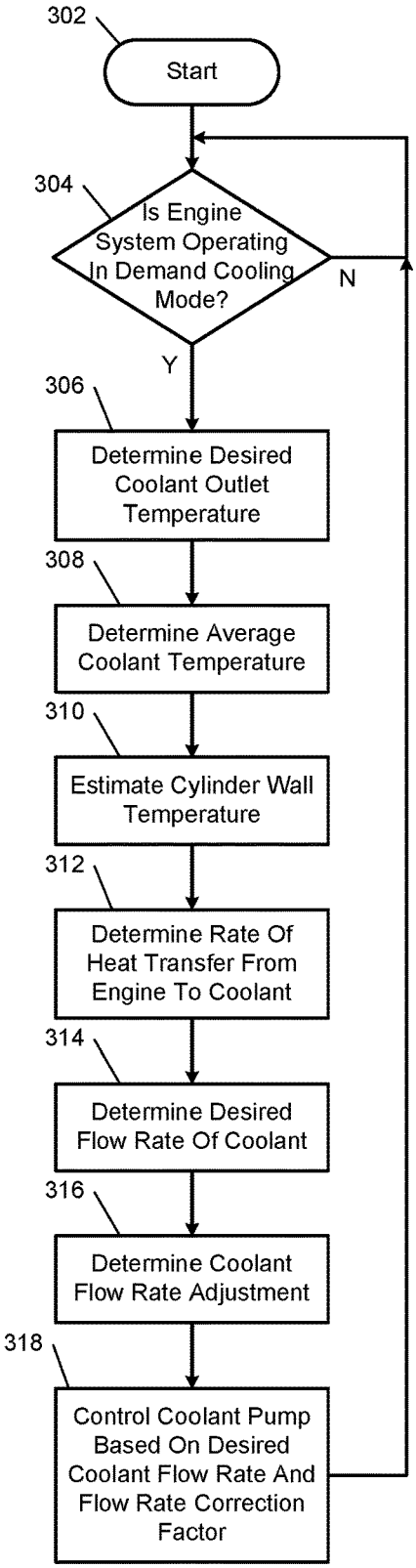
FIG. 3 is a flowchart illustrating an example method of controlling a coolant pump based on an estimated cylinder wall temperature according to the principles of the present disclosure.

Referring now to FIG. 3, a method for controlling coolant flow through an engine begins at 302. The method is described in the context of the modules in the example implementation of the ECM 144 shown in FIG. 2. However, the particular modules that perform the steps of the method may be different than the modules mentioned below and/or the method may be implemented apart from the modules of FIG. 2.

At 304, the desired flow rate module 214 determines whether the engine system 100 is operating in a demand cooling mode. If the engine system 100 is operating in the demand cooling mode, the method continues at 306. Otherwise, the desired flow rate module 214 continues to determine whether the engine system 100 is operating in a demand cooling mode.

The engine system 100 may be operating in the demand cooling mode when the ECM 144 is actively controlling coolant flow through the engine 102 to adjust the temperature of the coolant. For example, the engine system 100 may be operating in the demand cooling mode when the actual flow rate of the coolant is greater than zero. The actual flow rate of the coolant may be assumed to be greater than zero when the commanded pump speed indicated by the pump control signal 152 is greater than zero.

At 306, the coolant temperature module 204 determines the desired coolant outlet temperature. At 308, the coolant temperature module 204 determines the average coolant temperature. At 310, the temperature estimation module 206 estimates the cylinder wall temperature.

At 312, the heat transfer rate module 212 determines the rate of heat transfer from the engine 102 to coolant flowing through the engine 102. The heat transfer rate module 212 may use relationships (8), (9), or (10) to determine the heat transfer rate. If relationship (8) is used, the heat transfer rate module 212 may determine the desired rate of heat rejection from the engine 102. In addition, the engine heat absorption module 208 may determine the actual rate of change in heat absorbed by the engine 102, and the coolant heat absorption module 210 may determine the actual rate of change in heat absorbed by coolant flowing through the engine 102.

At 314, the desired flow rate module 214 determines the desired flow rate of coolant flow through the engine 102. The desired flow rate module 214 may use relationship (11) to determine the desired coolant flow rate. Alternatively, the desired flow rate module 214 may use relationship (12), (13), (14), or (15) to determine the desired coolant flow rate. In this latter case, the heat transfer rate module 212 may not determine the heat transfer rate (i.e., 312 may be omitted from the method).

At 316, the flow rate adjustment module 216 determines the coolant flow rate adjustment. At 318, the pump control module 218 controls the coolant pump 122 based on the desired coolant flow rate and the coolant flow rate adjustment. In one example, the pump control module 218 controls the speed of the coolant pump 122 to minimize a difference between the actual coolant flow rate and a sum of the desired coolant flow rate and the coolant flow rate adjustment.

Figure 4:
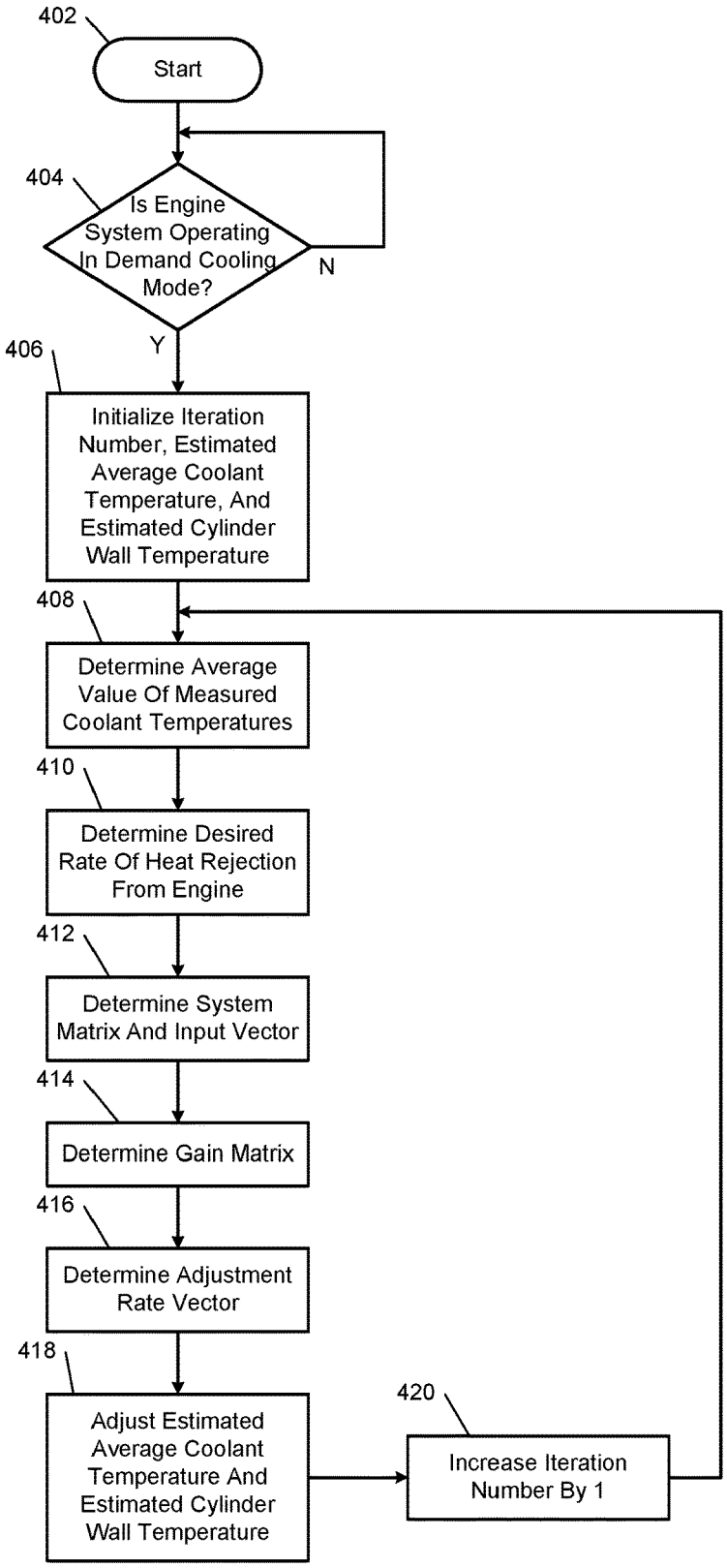
FIG. 4 is a flowchart illustrating an example method of estimating a cylinder wall temperature according to the principles of the present disclosure.

Referring now to FIG. 4, a method for estimating the temperature of a cylinder wall in an engine begins at 402. The method of FIG. 4 may be executed in conjunction with the method of FIG. 3. For example, the method of FIG. 4 may be executed at 310 of FIG. 3 to estimate the cylinder wall temperature. Alternatively, the methods of FIGS. 3 and 4 may be executed independently. The method of FIG. 4 is described in the context of the modules in the example implementation of the ECM 144 shown in FIG. 2. However, the particular modules that perform the steps of the method of FIG. 4 may be different than the modules mentioned below and/or the method of FIG. 4 may be implemented apart from the modules of FIG. 2.

At 404, the desired flow rate module 214 determines whether the engine system 100 is operating in a demand cooling mode. If the engine system 100 is operating in the demand cooling mode, the method continues at 406. Otherwise, the desired flow rate module 214 continues to determine whether the engine system 100 is operating in a demand cooling mode.

At 406, the temperature estimation module 206 initializes the iteration number, the estimated average coolant temperature, and the estimated cylinder wall temperature. The temperature estimation module 206 may initialize the iteration number by setting the iteration number equal to zero. The temperature estimation module 206 may initialize the estimated average coolant temperature and the estimated cylinder wall temperature by setting each of these two values equal to the average measured coolant temperature.

At 408, the coolant temperature module 204 determines the average measured coolant temperature. As noted above, the average measured coolant temperature is the average value of the coolant inlet temperature measured by the CIT sensor 130 and the coolant outlet temperature measured by the COT sensor 132. The average measured coolant temperature may be determined before and/or after initializing the estimated average coolant temperature and the estimated cylinder wall temperature.

At 410, the heat transfer rate module 212 determines the desired rate of heat rejection from the engine 102. As noted above, the heat transfer rate module 212 may determine the desired rate of heat rejection from the engine 102 based on the engine speed and the air per cylinder. Alternatively, the heat transfer rate module 212 may determine the desired rate of heat rejection from the engine 102 based on the engine speed and the desired torque output of the engine 102.

At 412, the temperature estimation module 206 determines the system matrix and the input vector for iteration number k. The temperature estimation module 206 may use relationship (3) to determine the system matrix for iteration number k. The temperature estimation module 206 may use relationship (4) to determine the input vector for iteration number k.

At 414, the temperature estimation module 206 determines the gain matrix. The temperature estimation module 206 may use relationship (5) to determine the gain matrix. At 416, the temperature estimation module 206 determines the adjustment rate vector for iteration number k. The temperature estimation module 206 may use relationship (2) to determine the adjustment rate vector for iteration number k.

At 418, the temperature estimation module 206 adjusts previous estimates of the average coolant temperature and the estimated cylinder wall temperature. In other words, the temperature estimation module 206 may generate new estimates of the average coolant temperature and the cylinder wall temperature for iteration number k+1. The temperature estimation module 206 may use relationship (1) to estimate the average coolant temperature and the cylinder wall temperature for iteration number k+1.

At 420, the temperature estimation module 206 increases the iteration number by one. For example, the temperature estimation module 206 may increase the iteration number from k+1 to k+2. The temperature estimation module 206 may then continue at 408. The sample period used in relationship (1) to estimate the average coolant temperature and the cylinder wall temperature may be the period that elapses as the temperature estimation module 206 executes a single iteration of a loop including 408, 410, 412, 414, 416, 418, and 420.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a temperature estimation module that:

estimates a temperature of coolant flowing through an engine; and estimates a temperature of a cylinder wall in the engine based on a difference between a measured coolant temperature and the estimated coolant temperature, a mass flow rate of coolant flowing through the engine and a desired rate of heat rejection from the engine; and a pump control module that controls a coolant pump to adjust an actual rate of coolant flow through the engine based on the estimated cylinder wall temperature.

2. The system of claim 1 wherein:

the measured coolant temperature is an average value of a measured temperature of coolant entering the engine and a measured temperature of coolant exiting the engine; and the estimated coolant temperature is an estimated average value of a temperature of coolant entering the engine and a temperature of coolant exiting the engine.

3. The system of claim 1 wherein the temperature estimation module determines the mass flow rate of coolant flowing through the engine based on a speed of the coolant pump.

4. The system of claim 1 further comprising a heat transfer rate module that determines the desired rate of heat rejection from the engine based on a speed of the engine and at least one of a desired torque output of the engine and an amount of air delivered to a cylinder of the engine.

5. The system of claim 1 wherein the temperature estimation module estimates the coolant temperature and the cylinder wall temperature based on previous estimates of the coolant temperature and the cylinder wall temperature, a sampling period, and an adjustment rate vector.

6. The system of claim 5 wherein the temperature estimation module determines the adjustment rate vector based on a system matrix, the previous estimates of the coolant temperature and the cylinder wall temperature, an input vector, a gain matrix, and the difference between the estimated coolant temperature and the measured coolant temperature.

7. The system of claim 6 wherein the temperature estimation module determines the system matrix based on a heat transfer coefficient of the cylinder wall, a surface area of the cylinder wall, a mass of the cylinder wall, a specific heat of the cylinder wall, a mass of coolant flowing through the engine, a specific heat of coolant flowing through the engine, and the mass flow rate of coolant flowing through the engine.

8. The system of claim 6 wherein the temperature estimation module determines the input vector based on the mass flow rate of coolant flowing through the engine, a mass of coolant flowing through the engine, a measured temperature of coolant entering the engine, the desired rate of heat rejection from the engine, a mass of the cylinder wall, and a specific heat of the cylinder wall.

9. A method comprising:

estimating a temperature of coolant flowing through an engine;

estimating a temperature of a cylinder wall in the engine based on a difference between a measured coolant temperature and the estimated coolant temperature, a mass flow rate of coolant flowing through the engine and a desired rate of heat rejection from the engine; and controlling a coolant pump to adjust an actual rate of coolant flow through the engine based on the estimated cylinder wall temperature.

10. The method of claim 9 wherein:

the measured coolant temperature is an average value of a measured temperature of coolant entering the engine and a measured temperature of coolant exiting the engine; and the estimated coolant temperature is an estimated average value of a temperature of coolant entering the engine and a temperature of coolant exiting the engine.

11. The method of claim 9 further comprising determining the mass flow rate of coolant flowing through the engine based on a speed of the coolant pump.

12. The method of claim 9 further comprising determining the desired rate of heat rejection from the engine based on a speed of the engine and at least one of a desired torque output of the engine and an amount of air delivered to a cylinder of the engine.

13. The method of claim 9 further comprising estimating the coolant temperature and the cylinder wall temperature based on previous estimates of the coolant temperature and the cylinder wall temperature, a sampling period, and an adjustment rate vector.

14. The method of claim 13 further comprising determining the adjustment rate vector based on a system matrix, the previous estimates of the coolant temperature and the cylinder wall temperature, an input vector, a gain matrix, and the difference between the estimated coolant temperature and the measured coolant temperature.

15. The method of claim 14 further comprising determining the system matrix based on a heat transfer coefficient of the cylinder wall, a surface area of the cylinder wall, a mass of the cylinder wall, a specific heat of the cylinder wall, a mass of coolant flowing through the engine, a specific heat of coolant flowing through the engine, and the mass flow rate of coolant flowing through the engine.

16. The method of claim 14 further comprising determining the input vector based on the mass flow rate of coolant flowing through the engine, a mass of coolant flowing through the engine, a measured temperature of coolant entering the engine, the desired rate of heat rejection from the engine, a mass of the cylinder wall, and a specific heat of the cylinder wall.

* * * * *